US012391453B2

(12) United States Patent
Carlos-Wallace

(10) Patent No.: US 12,391,453 B2
(45) Date of Patent: Aug. 19, 2025

(54) CANNABIS STORAGE CONTAINER COVER

(71) Applicant: Christopher Carlos-Wallace, El Sobrante, CA (US)

(72) Inventor: Christopher Carlos-Wallace, El Sobrante, CA (US)

( * ) Notice: Subject to any disclaimer, the term of this patent is extended or adjusted under 35 U.S.C. 154(b) by 161 days.

(21) Appl. No.: 17/969,560

(22) Filed: Oct. 19, 2022

(65) Prior Publication Data

US 2023/0042574 A1 Feb. 9, 2023

Related U.S. Application Data

(63) Continuation-in-part of application No. 17/880,520, filed on Aug. 3, 2022, now abandoned, which is a continuation of application No. 17/074,487, filed on Nov. 23, 2020, now Pat. No. 11,440,722.

(60) Provisional application No. 63/259,850, filed on Aug. 19, 2021, provisional application No. 63/047,866, filed on Jul. 2, 2020.

(51) Int. Cl.
*B65D 81/20* (2006.01)
*A24F 23/00* (2006.01)

(52) U.S. Cl.
CPC ..... *B65D 81/2038* (2013.01); *A24F 23/00* (2013.01); *B65D 81/2076* (2013.01)

(58) Field of Classification Search
CPC ..... B65D 25/06; B65D 81/245; B65D 81/20; B65D 81/2007; B65D 81/2038; B65D 81/2076; A24F 23/00
USPC ..... 220/580, 202, 203.01, 203.29, 367.1; 206/248, 260, 265, 524.8
See application file for complete search history.

(56) References Cited

U.S. PATENT DOCUMENTS 2,096,358 A * 10/1937 Gautier ..... B65D 81/245 220/580
2,172,457 A * 9/1939 Schwartz ..... B65D 43/022 220/580
2,726,012 A * 12/1955 Jensen ..... A47J 47/06 426/131
3,164,289 A * 1/1965 Cocchiarella ..... B65D 81/245 D7/354
3,784,051 A * 1/1974 Shaw ..... B65D 81/245 220/580
4,093,009 A 6/1978 Iavarone et al.
4,416,387 A * 11/1983 D'Antonio ..... B65D 81/245 220/579
4,828,139 A * 5/1989 Capitani ..... B65D 45/345 220/319
4,952,765 A * 8/1990 Toyosawa ..... A47J 36/027 99/410
5,145,077 A 9/1992 Rohrig
5,213,230 A * 5/1993 Kral ..... B44D 3/12 220/216
5,628,404 A 5/1997 Hendrix
7,494,025 B2 * 2/2009 Porter ..... B65D 43/022 220/756

(Continued)

*Primary Examiner* — Luan K Bui
(74) *Attorney, Agent, or Firm* — Squire Patton Boggs (US) LLP

(57) ABSTRACT

Described herein is a *cannabis* storage container and associated method. The method can include covering a *cannabis* storage container with a cover. The cover can include a gas injection port and a vent. The method can also include injecting an inert gas through the gas injection port. An example of inert gas is Argon. The method can further include removing oxygen through the vent.

5 Claims, 19 Drawing Sheets

(56) References Cited

U.S. PATENT DOCUMENTS

| | | | | |
|---|---|---|---|---|
| 8,967,412 | B2 | 3/2015 | Loging | |
| 2005/0035021 | A1 | 2/2005 | Higer et al. | |
| 2006/0144726 | A1 | 7/2006 | Foust et al. | |
| 2006/0213802 | A1 | 9/2006 | Poo et al. | |
| 2007/0095712 | A1 | 5/2007 | Miles | |
| 2007/0228051 | A1 | 10/2007 | Meroni | |
| 2011/0042249 | A1* | 2/2011 | Guerrera ..... | B65D 85/1027 206/274 |
| 2012/0267369 | A1* | 10/2012 | Duvigneau ..... | B65D 43/0204 220/795 |
| 2020/0377280 | A1 | 12/2020 | Pace et al. | |

* cited by examiner

CANNABIS STORAGE CONTAINER COVER

CROSS-REFERENCE TO RELATED APPLICATIONS

The present application claims the priority benefit of, and is a Non-Provisional of, U.S. Provisional Patent Application No. 63/259,850, filed on Aug. 19, 2021. The present application is also a Continuation-in-Part of Ser. No. 17/880,520 filed on Aug. 3, 2022, which is Continuation of U.S. patent application Ser. No. 17/074,487, filed on Nov. 23, 2020, which claims the priority benefit of U.S. Provisional Patent Application No. 63/047,866, filed on Jul. 2, 2020. The entire contents of the above-referenced applications are hereby incorporated by reference.

FIELD OF THE INVENTION

The invention relates generally to a storage container having particular use in storing and preserving *cannabis*.

BACKGROUND

Currently there are a number of solutions for preserving *cannabis*. One of these solutions attempts to utilize a zip-top bag, but this solution fails to meet the needs of the market because it does not generally provide an odor free and sealed reusable container. Another solution attempts to utilize glass jars, but this solution is similarly unable to meet the needs of the market because it does not have an assembly configured to remove air from within the jar interior. Still another solution seeks to vacuum a sealed container, but this solution also fails to meet market needs because a user may not have the equipment to vacuum seal the container. For larger volumes, various tubs, bins, and barrels have been used to distribute larger volumes. Typically, these are

SUMMARY OF THE INVENTION

It would be advantageous to have an apparatus for the storage and preservation of *cannabis* that is airtight. Furthermore, it would also be advantageous to have an apparatus for the storage and preservation of *cannabis* that is child-proof. Still further, it would be advantageous to have an apparatus comprised of a container that is tinted so as to act as a filter that blocks ultraviolet (UV) light from entering into an interior of said container. It would still further be advantageous to have an apparatus comprised of a container in which a volume of air within an interior of said container is capable of being reduced and/or in which a ratio of oxygen in the air is capable of being reduced. Therefore, there currently exists a need in the market for an apparatus for the storage and preservation of *cannabis* that overcomes the aforementioned deficiencies.

The present invention advantageously fills the aforementioned deficiencies by providing an apparatus and a storage container specially adapted for the storage of *cannabis*, which provides for the long-term preservation of *cannabis*.

In one aspect, the invention provides a container for the storage and preservation of *cannabis*, the container comprising a compressor portion configured with a size and a shape corresponding to an interior dimension of the container. In embodiments, the compressor portion is housed within an interior of the container, and is operable to reduce a volume of air within the interior between a bottom of the container and the compressor portion. In embodiments, the container comprises a top portion configured for removable receipt of a cap. In embodiments, the compressor portion further comprises an input pinhole for injection of an inert gas into the interior of the container between the bottom of the container and the compressor portion. In embodiments, the compressor portion further comprises an output valve through which air within said interior between bottom of said container and the compressor portion can escape as the volume of air is being reduced, or as the volume of air is being displaced by the injection of the inert gas.

In embodiments, the container is an air-tight *cannabis* storage and preservation container.

In embodiments, the cap comprises a childproof cap.

In embodiments, the container is comprised of a glass material. In embodiments, the glass material is tinted so as to block UV light from entering into an interior of the container.

In embodiments, the container further comprises a temperature strip positioned on an exterior portion of the container, capable to display an internal temperature of the container.

In embodiments, the compressor portion is comprised of silicone.

In another aspect, the invention provides a *cannabis* storage apparatus for airtight storage and preservation of *cannabis*. In embodiments, the apparatus comprises a cylindrical glass container that includes a silicone compressor portion of a size and a shape corresponding to an interior dimension of the cylindrical glass container. In embodiments, the compressor portion is housed within an interior of the cylindrical glass container, and is operable to reduce a volume of air within the interior between a bottom of the cylindrical glass container and the compressor portion.

In embodiments, the compressor portion comprises an input pinhole for injection of an inert gas into the interior of the cylindrical glass container between the bottom of the cylindrical glass container and the compressor portion, and an output valve through which air within the interior between the bottom of the cylindrical glass container and the compressor portion can escape as the volume of air is being reduced, or is being displaced by the inert gas.

In embodiments, the apparatus includes an internal storage bag that is porous to allow for transmission of gasses therethrough.

In embodiments, the apparatus has a nitrogen infusing hose and nozzle for injection of nitrogen into the interior of the cylindrical glass container between the bottom of the cylindrical glass container and the compressor portion.

In embodiments of the apparatus, the cylindrical glass container further comprises a top portion configured for removable receipt of a cap. In embodiments, the cap comprises a child-proof cap.

In embodiments of the apparatus, the cylindrical glass container is tinted for blockage of UV light from entering the interior of the cylindrical glass container.

In embodiments, the apparatus further comprises a temperature strip positioned on an exterior portion (e.g., on a front) of the cylindrical glass container for displaying to a user an internal temperature of the cylindrical glass container.

In embodiments, the apparatus fulfills the need for storing and preserving *cannabis*, including long-term preservation of *cannabis*.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Following are more detailed descriptions of various related concepts related to, and embodiments of, the *cannabis* container and apparatus according to the present disclosure. It should be appreciated that various aspects of the subject matter introduced above and discussed in greater detail below may be implemented in any of numerous ways, as the subject matter is not limited to any particular manner of implementation. Examples of specific implementations and applications are provided primarily for illustrative purposes.

As mentioned, the invention is an improved storage container and apparatus specifically adapted with features for the storage of *cannabis*.

In particular embodiments, the invention is a childproof, airtight, *cannabis* preserving container.

Turning now to the figures, FIGS. 1-16 illustrate various embodiments of the apparatus of the present disclosure, including a *cannabis* storage container and associated materials.

Figure 1:
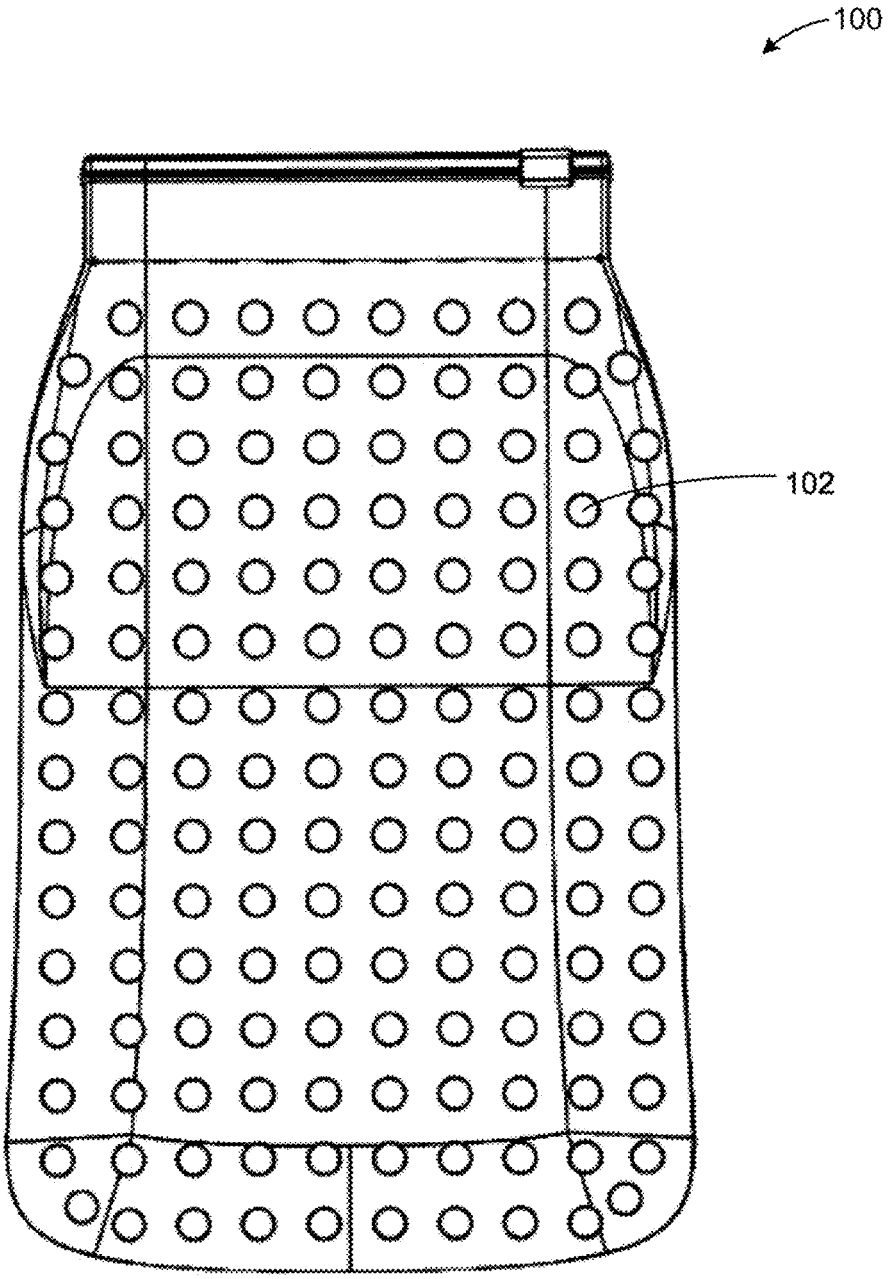
FIG. 1 shows the front of a porous bag according to embodiments of the present disclosure.
Figure 2:
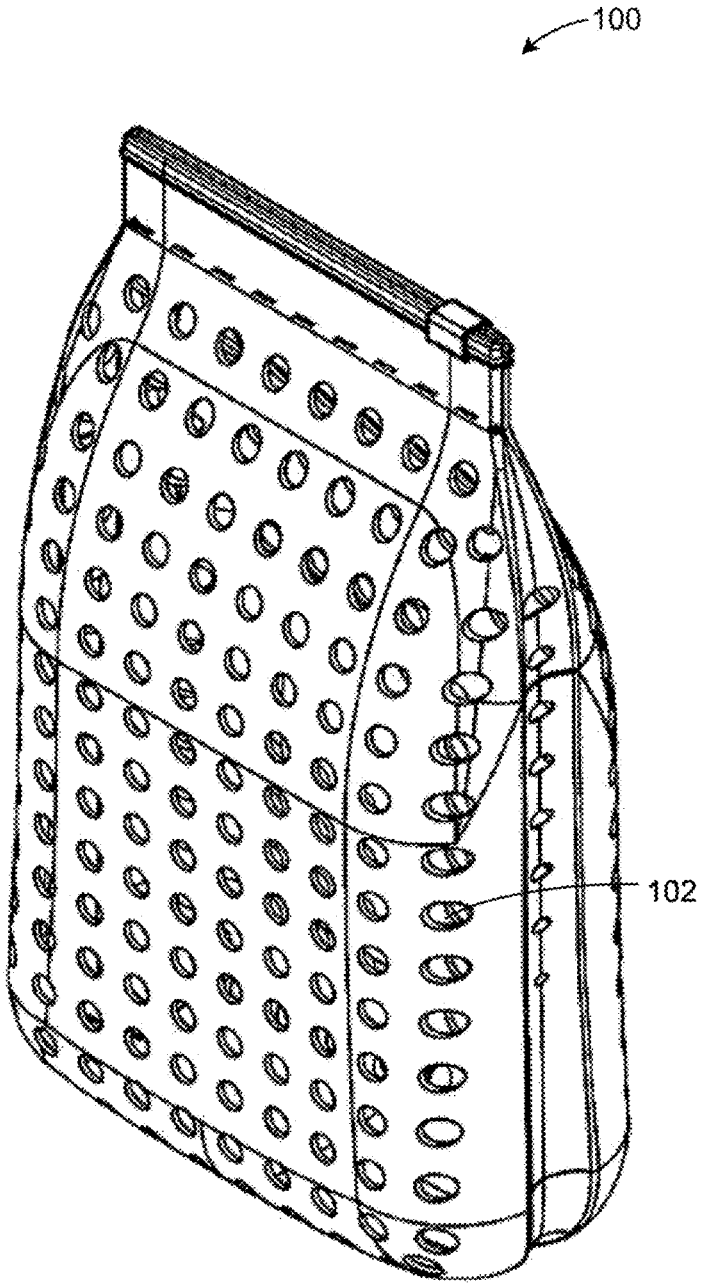
FIG. 2 shows a perspective view of the porous bag of FIG. 1.
Figure 3:
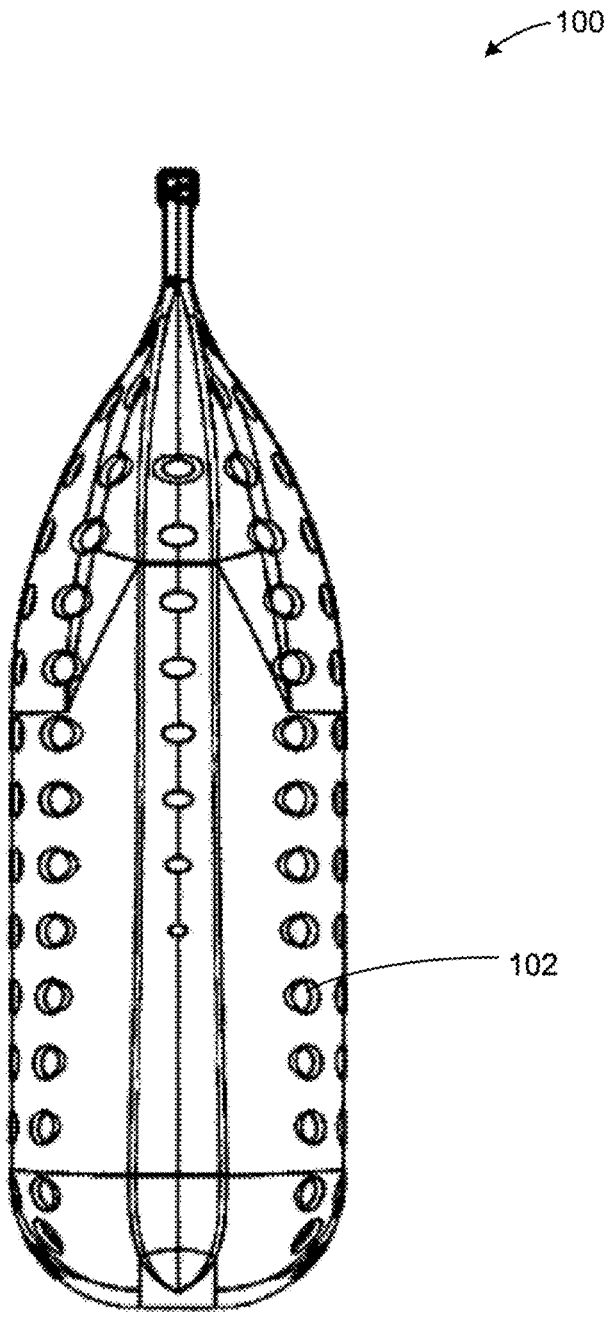
FIG. 3 shows a side view of the porous bag of FIGS. 1-2.
Figure 4:
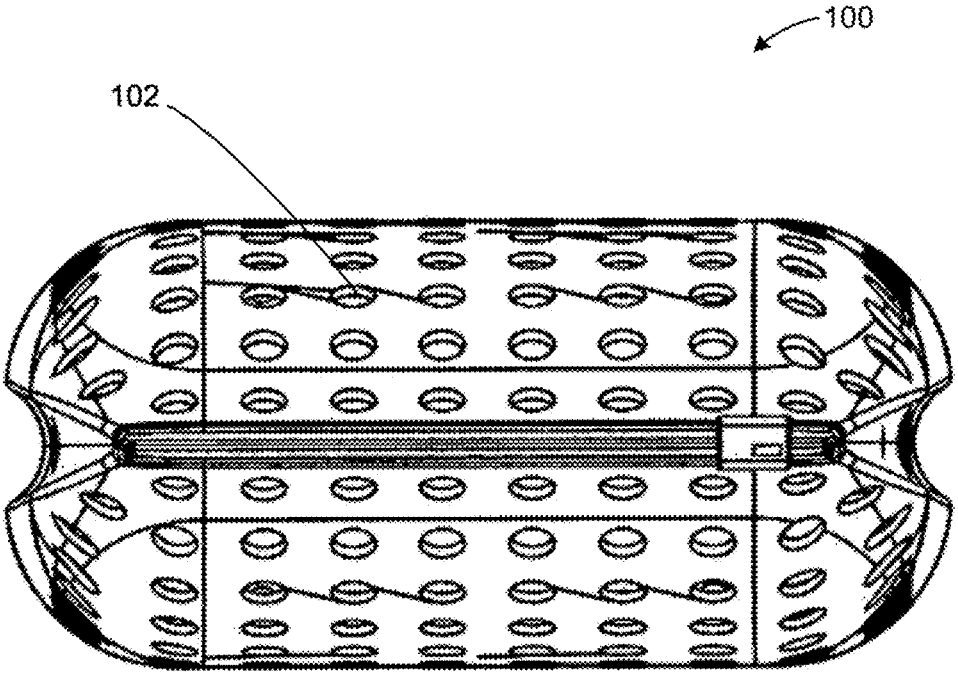
FIG. 4 shows a top view of the porous bag of FIGS. 1-3.

FIG. 1 illustrates a bag 100 for use with the apparatus and storage container of the present disclosure as viewed from a front of the bag. As shown, bag 100 includes a plurality of pores 102 to allow for transmission of gasses between the bag and an interior of a *cannabis* container of the present disclosure. Thus, it is to be understood that bag 100 can be included in the interior of a *cannabis* container of the present disclosure. The porous nature of the bag can allow for displacement of air, for example displacement of air with an inert gas. FIGS. 2-4 depict additional views of bag 100 for reference.

Figure 5:
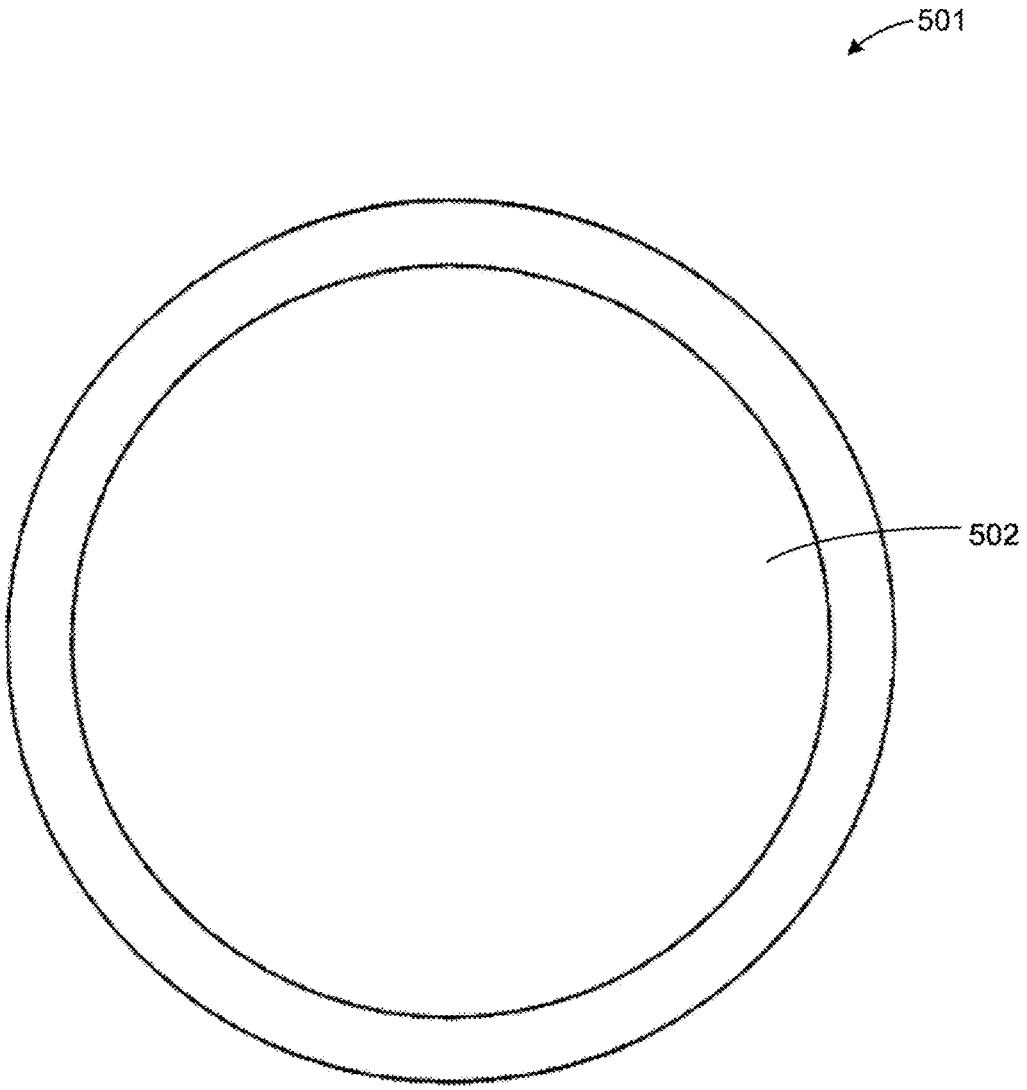
FIG. 5 shows the bottom of a *cannabis* container of the present disclosure.
Figure 6:
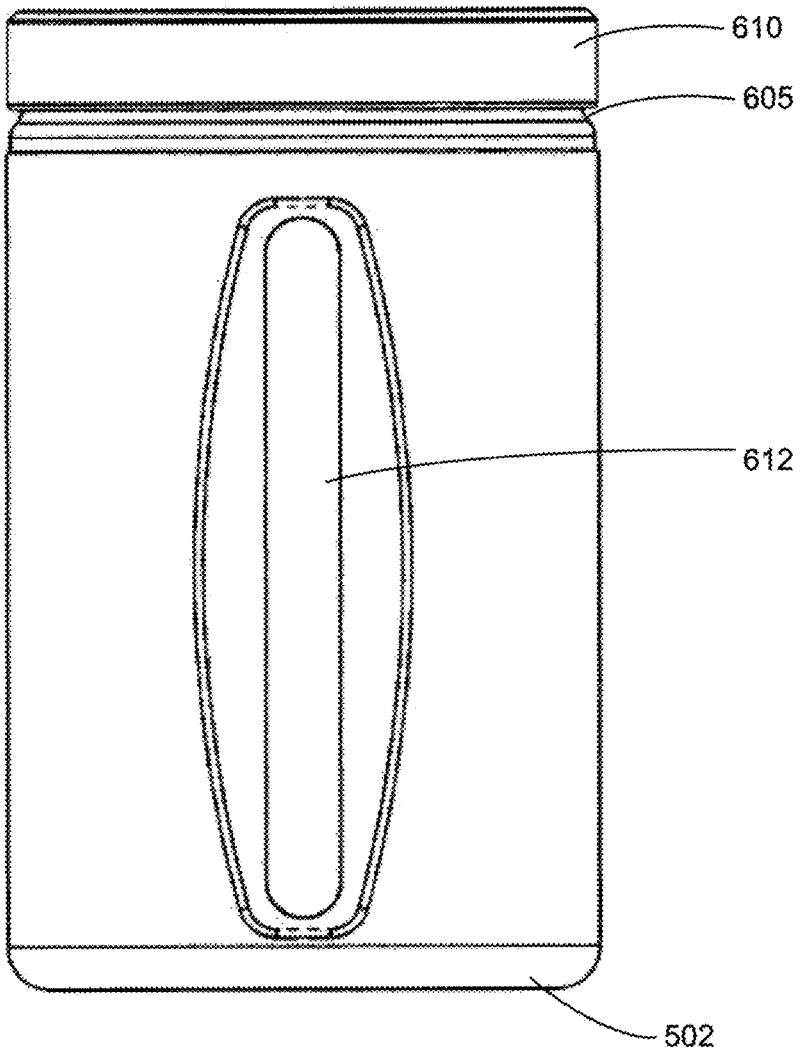
FIG. 6 shows a front view of the *cannabis* container of FIG. 5.

FIGS. 5-10 depict various views of embodiments of a *cannabis* container of the present disclosure. In the embodiments, the *cannabis* container is cylindrical. Turning to FIG. 5, depicted is a view of a bottom 502 of *cannabis* container 501. Turning to FIG. 6, depicted is a front view of *cannabis* container 501 illustrating bottom 502, top portion 605, and cap 610. Also shown at FIG. 6 is temperature strip 612. In embodiments, temperature strip 612 is positioned on the front of *cannabis* container 501, to provide a user with an indication of an internal temperature of *cannabis* container 501.

Figure 7:
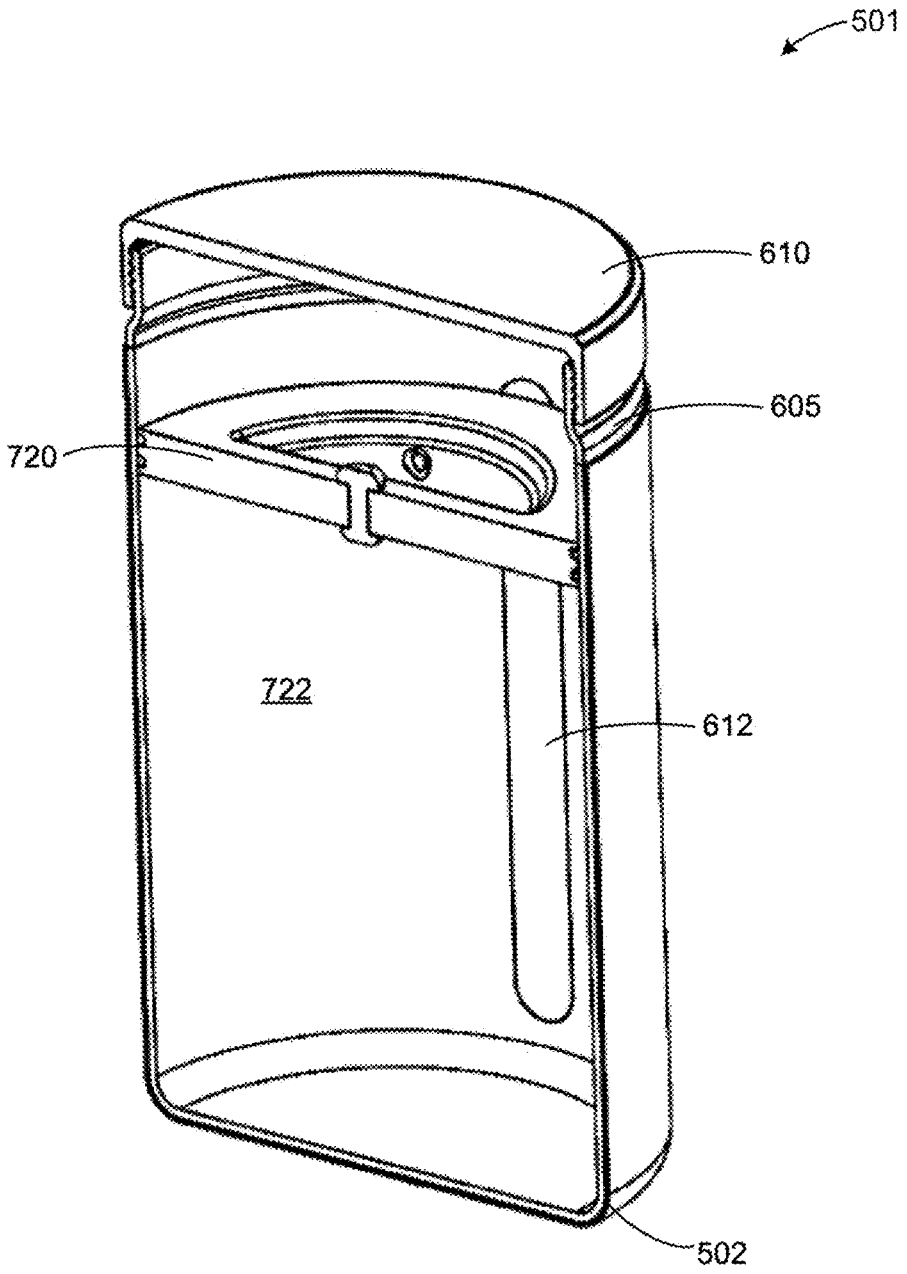
FIG. 7 shows a cross-sectional view of the *cannabis* container of FIGS. 5-6.

A cross-sectional view of *cannabis* container 501 is shown at FIG. 7. Shown are portions of bottom 502, top portion 605, and cap 610. Also shown is compressor portion 720. Compressor portion 720 is illustrated as being housed within an interior 722 of *cannabis* container 501. As can be seen, compressor portion 720 is generally configured with a size and a shape corresponding to an interior dimension of *cannabis* container 501, such that a circumference of compressor portion 720 abuts up against interior walls of *cannabis* container 501. In embodiments, compressor portion 720 is comprised of silicone. In embodiments, compressor portion 720 is configured to reduce a volume of air within interior 722 of *cannabis* container 501. As shown, compressor portion 720 is between bottom 502 and cap 610, under circumstances where cap 610 is attached to top portion 605 of *cannabis* container 501. Of course, when cap 610 is secured to top portion 605, a user cannot access compressor portion 720 as access would be prevented. Upon removal of cap 610, a user can access compressor portion 720, and via compressor portion 720 can reduce a volume of air within interior 722, particularly the volume of air between bottom 502 and compressor portion 720 of *cannabis* container 501.

Figure 8:
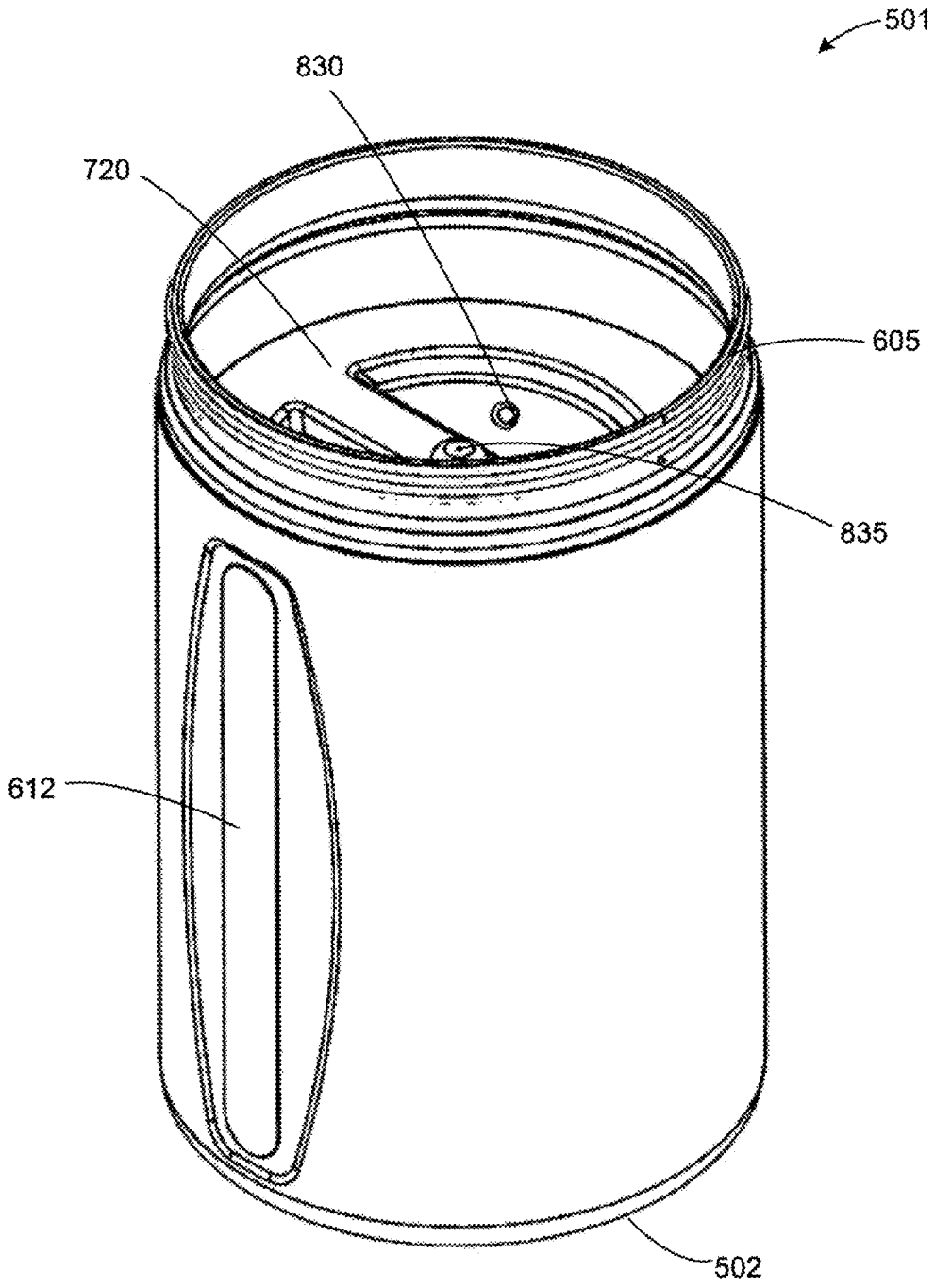
FIG. 8 shows a perspective view of the *cannabis* container of FIGS. 5-7, without a cap.
Figure 9:
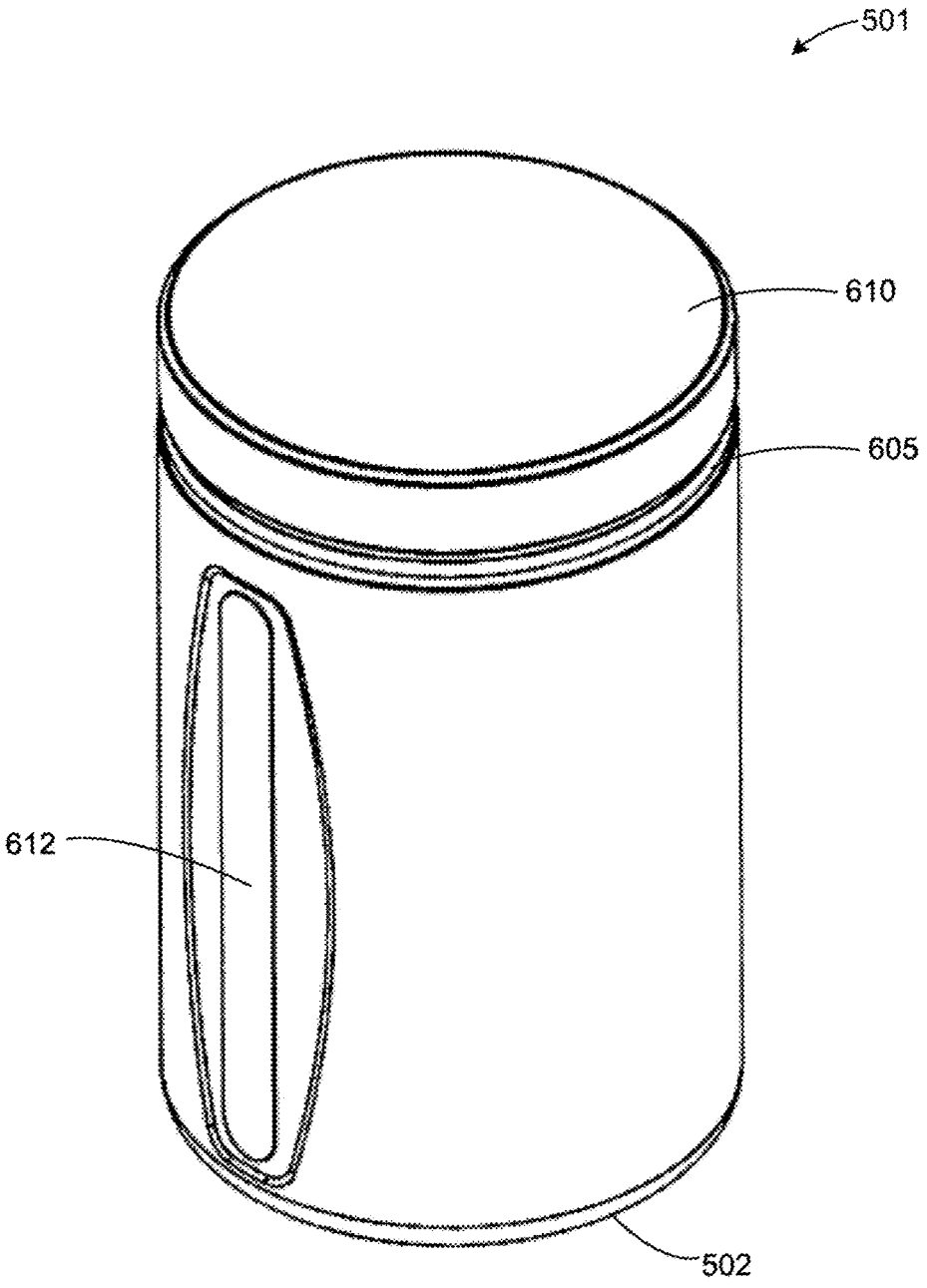
FIG. 9 shows the perspective view of the *cannabis* container of FIG. 8 with the cap secured to a top portion of the *cannabis* container.
Figure 10:
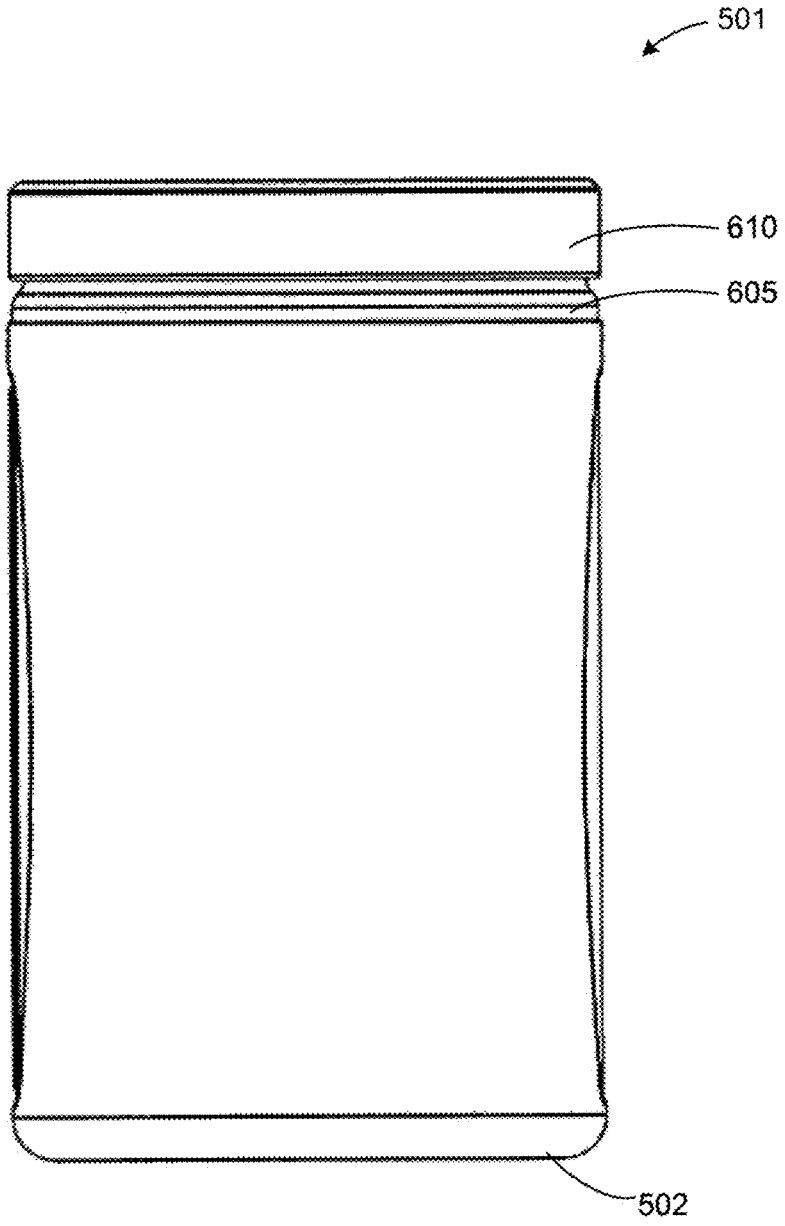
FIG. 10 shows a side view of the *cannabis* container of FIGS. 5-9.
Figure 15:
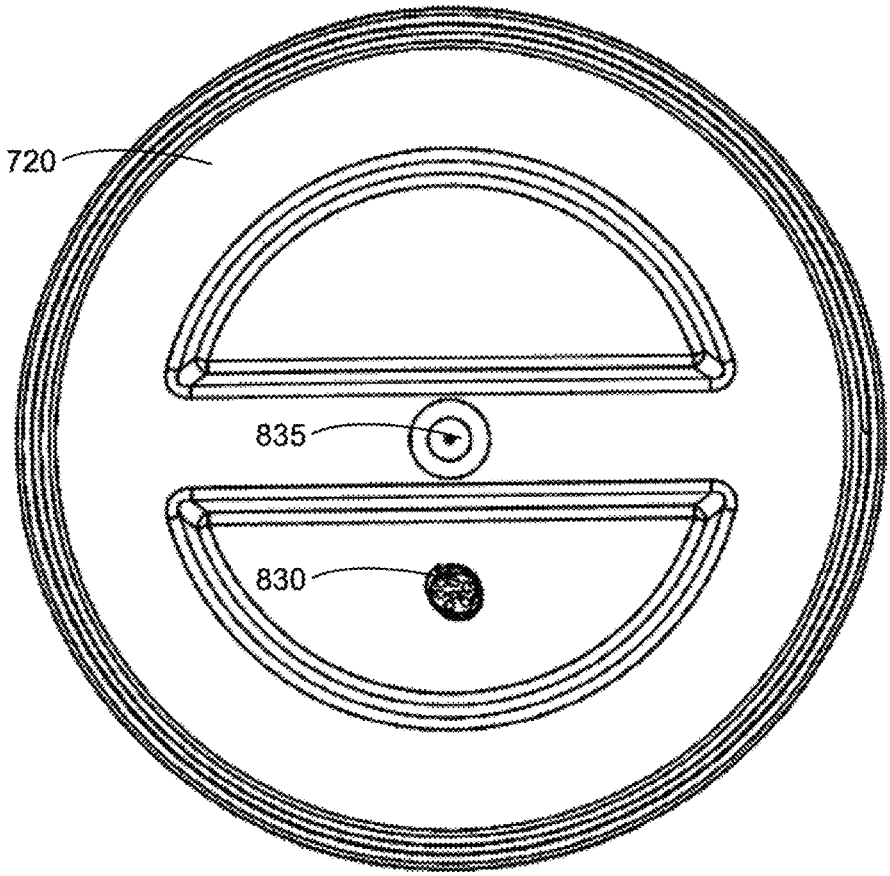
FIG. 15 shows a top view of the *cannabis* container of FIGS. 5-10, without the cap, illustrating a pinhole valve and an output valve.
Figure 16:
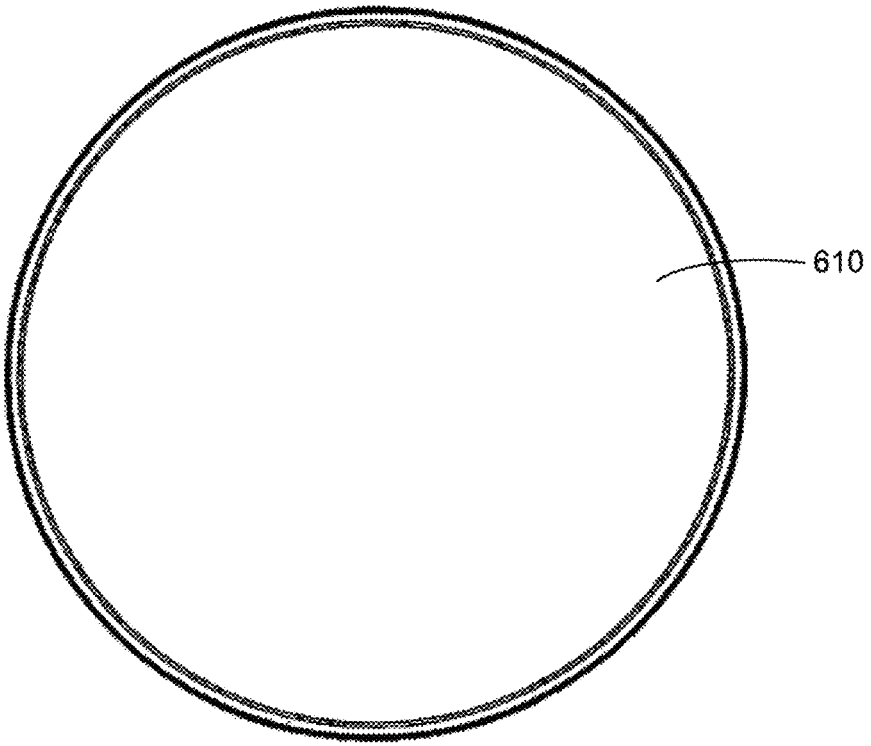
FIG. 16 shows the top view of the *cannabis* container of FIG. 15 with the cap secured to the top portion of the container.

FIG. 8 depicts a view of *cannabis* container 501 under circumstances in which the cap (e.g., cap 610) is not attached to top portion 605. As discussed, when top 605 is not attached, a user can access compressor portion 720, in order to reduce the volume of air within the interior of *cannabis* container 501. As can be seen at FIG. 8, compressor portion 720 includes pinhole valve 830, and output valve 835. Pinhole valve 830 can be used for injection of inert gases into the interior of *cannabis* container 501, for example after the volume of air has been reduced via compressor portion 720. Output valve 835 functions to allow air to be released as compressor portion 720 is used to reduce the volume of air, and additionally to allow air to be displaced under conditions where inert gas (e.g., nitrogen) is being added to the interior of the *cannabis* container by way of pinhole valve 830. For reference, FIG. 9 depicts an illustration of *cannabis* container 501 with cap 610 secured to top portion 605, and FIG. 10 depicts a side-view of *cannabis* container 501 with cap 610 attached. FIG. 15 depicts an illustration of an isolated view of compressor portion 720 as viewed from a top (i.e., viewed from a top of *cannabis* container 501 with cap 610 not attached), to illustrate pinhole valve 830 and output valve 835. FIG. 16 depicts an illustration of *cannabis* container 501 from a top view, where just top 610 can be seen.

Thus, in embodiments a *cannabis* container of the present disclosure comprises a cylindrical container (although other shapes are herein contemplated). In embodiments, the container can be comprised of a glass material defining an interior volume for the placement of *cannabis*. As discussed, the container has a top portion (e.g., top portion 605) configured for the removable receipt of a cap portion (e.g., cap 610). In embodiments, the cap portion can include a locking mechanism to secure the cap portion on the top portion in a child proof manner.

In a preferred embodiment of the present disclosure, the glass material of a *cannabis* container as herein described is tinted, thus acting as filter to block UV light from entering the container interior. As discussed, *cannabis* containers of the present disclosure include a compressor portion, generally configured with a size and shape corresponding to the interior dimension of the container, wherein the compressor portion is configured to reduce the volume of air within the container interior. The compressor portion may include a pinhole valve configured for the receipt of a needle and hose assembly for the injection of gasses, such as nitrogen, into the interior space of the container. Further, the device includes an internal storage bag for *cannabis* configured with a porous surface to allow for the transmission of gasses between the bag and container interior. Additionally, the exterior portion of the container may include a temperature gauge (e.g., temperature strip 612) configured to display the storage temperature (i.e., internal temperature) to a user. It will be understood that the device is configured in an assembly that is adaptable to multiple sizes.

Figure 11:
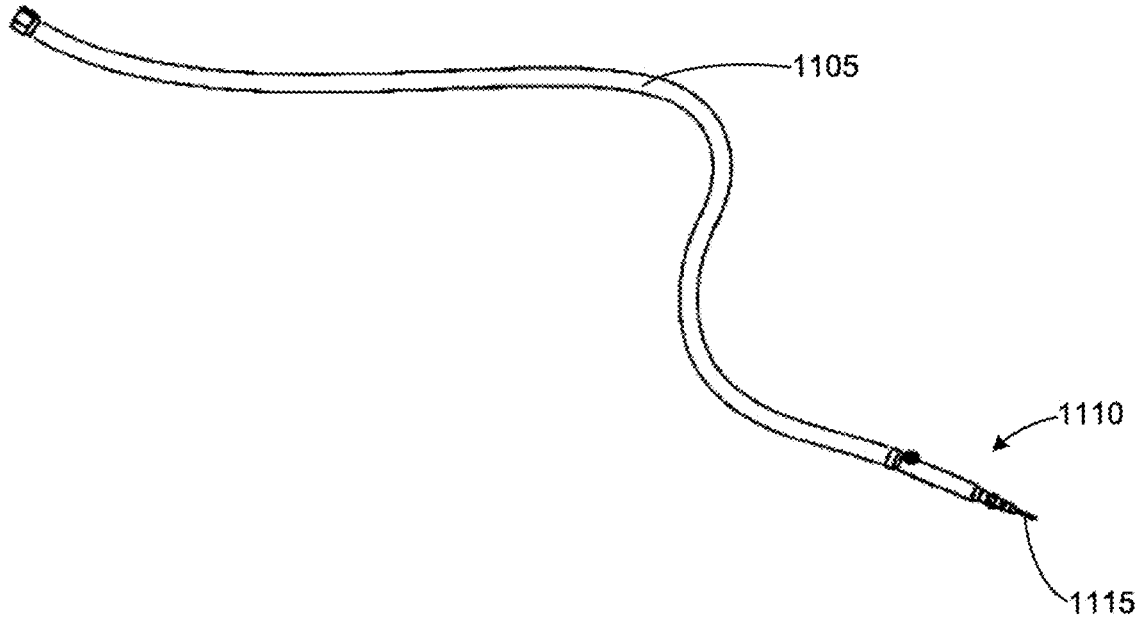
FIG. 11 shows a perspective view of a hose and nozzle capable to deliver inert gas to an interior of the *cannabis* container of FIGS. 5-9.
Figure 12:
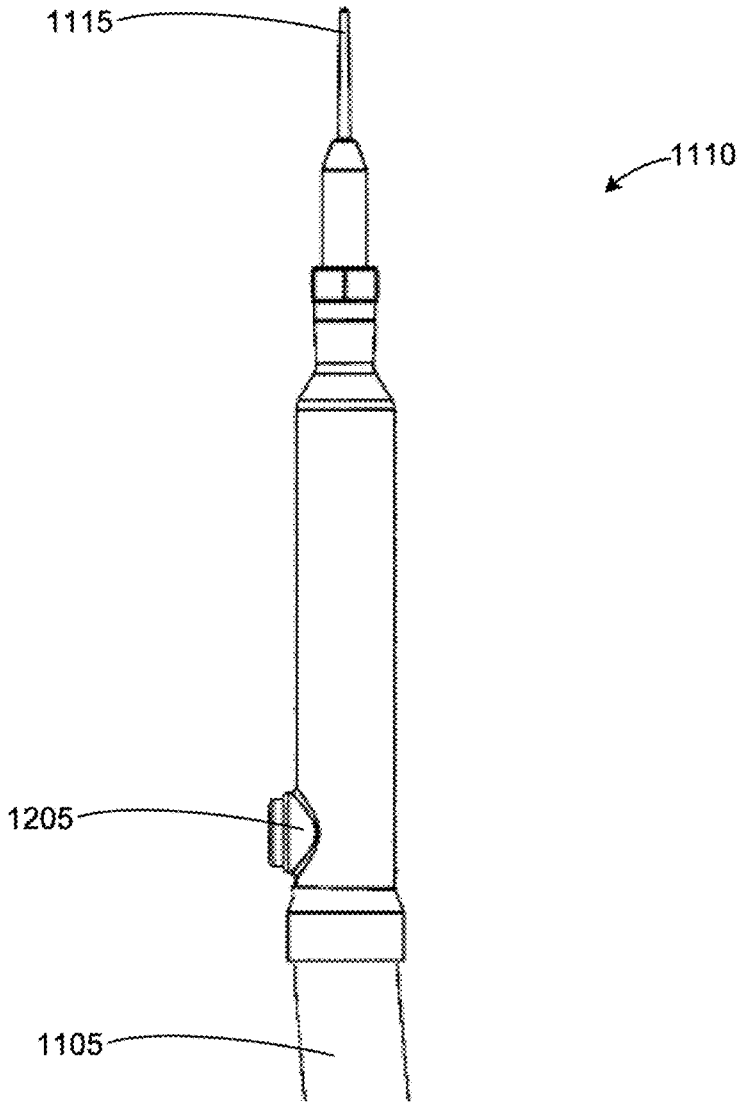
FIG. 12 shows a close-up view of the hose nozzle of FIG. 11.
Figure 13:
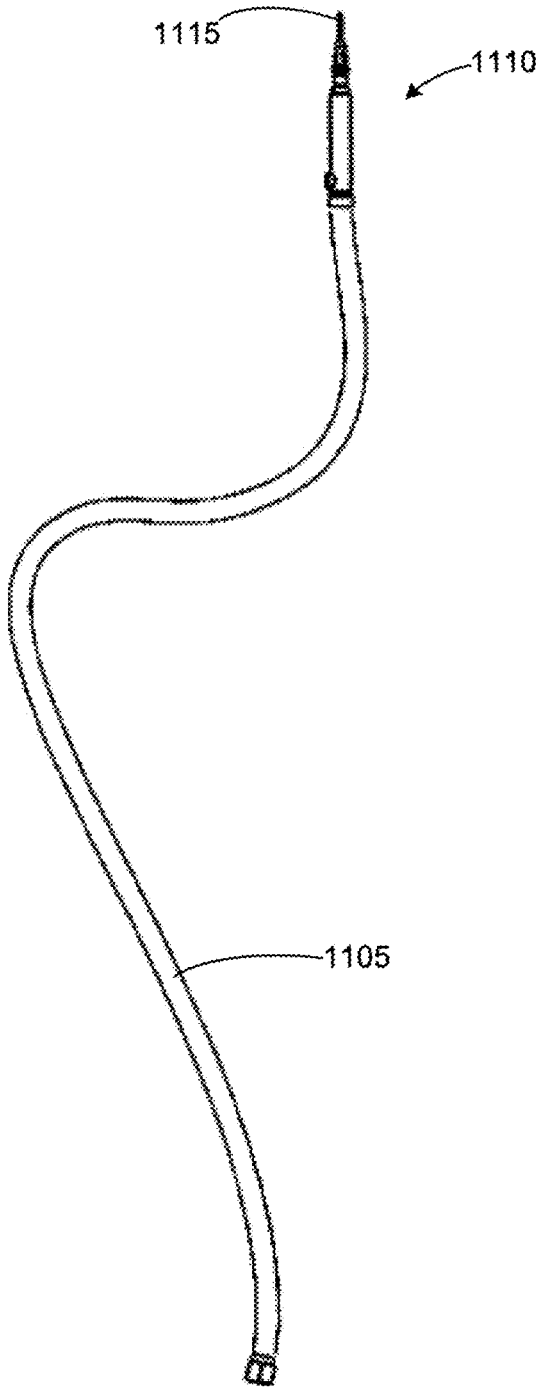
FIG. 13 shows another view of the hose and nozzle of FIG. 11.
Figure 14:
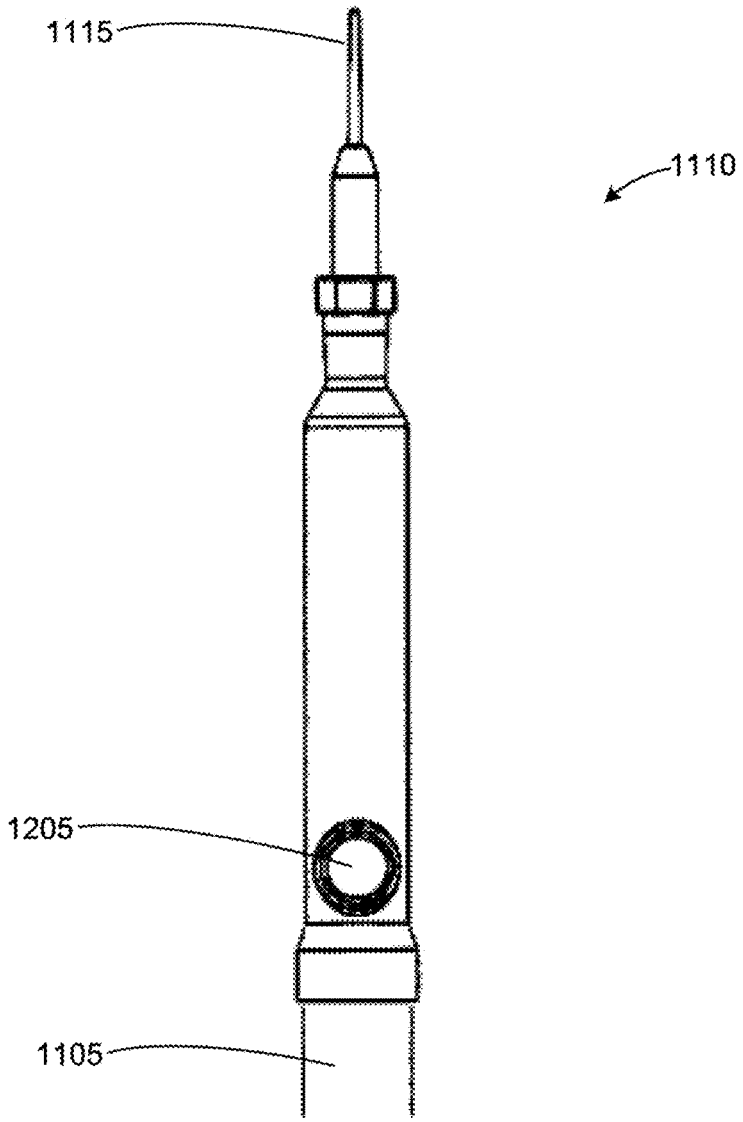
FIG. 14 shows another close-up view of the hose nozzle of FIG. 12 from a different angle.

As discussed, *cannabis* containers of the present disclosure are capable to receive inert gas injections into an interior space (e.g., between the compressor portion and the bottom), by way of a hose and nozzle configured such that a needle associated with the nozzle can be inserted into the pinhole valve (e.g., pinhole valve 830) for delivery of inert gas therethrough. Turning to FIG. 11, depicted is an exemplary illustration of such a hose 1105 coupled to nozzle 1110, the nozzle comprising needle 1115. FIG. 12 depicts a close-up view of nozzle 1110 from a side-angle, showing needle 1115, and also depicting actuator 1205 (e.g., knob, push button, etc.) for initiating flow of the inert gas. FIG. 13 depicts another view of the hose 1105 coupled to nozzle 1110, in turn coupled to needle 1115, and FIG. 14 depicts another close-up view of nozzle 1110, to further illustrate actuator 1205.

Various related embodiments of the invention are also described in Appendix A of Provisional Patent Application No. 63/047,866, the disclosure of which is incorporated herein by reference in its entirety.

Figure 17:
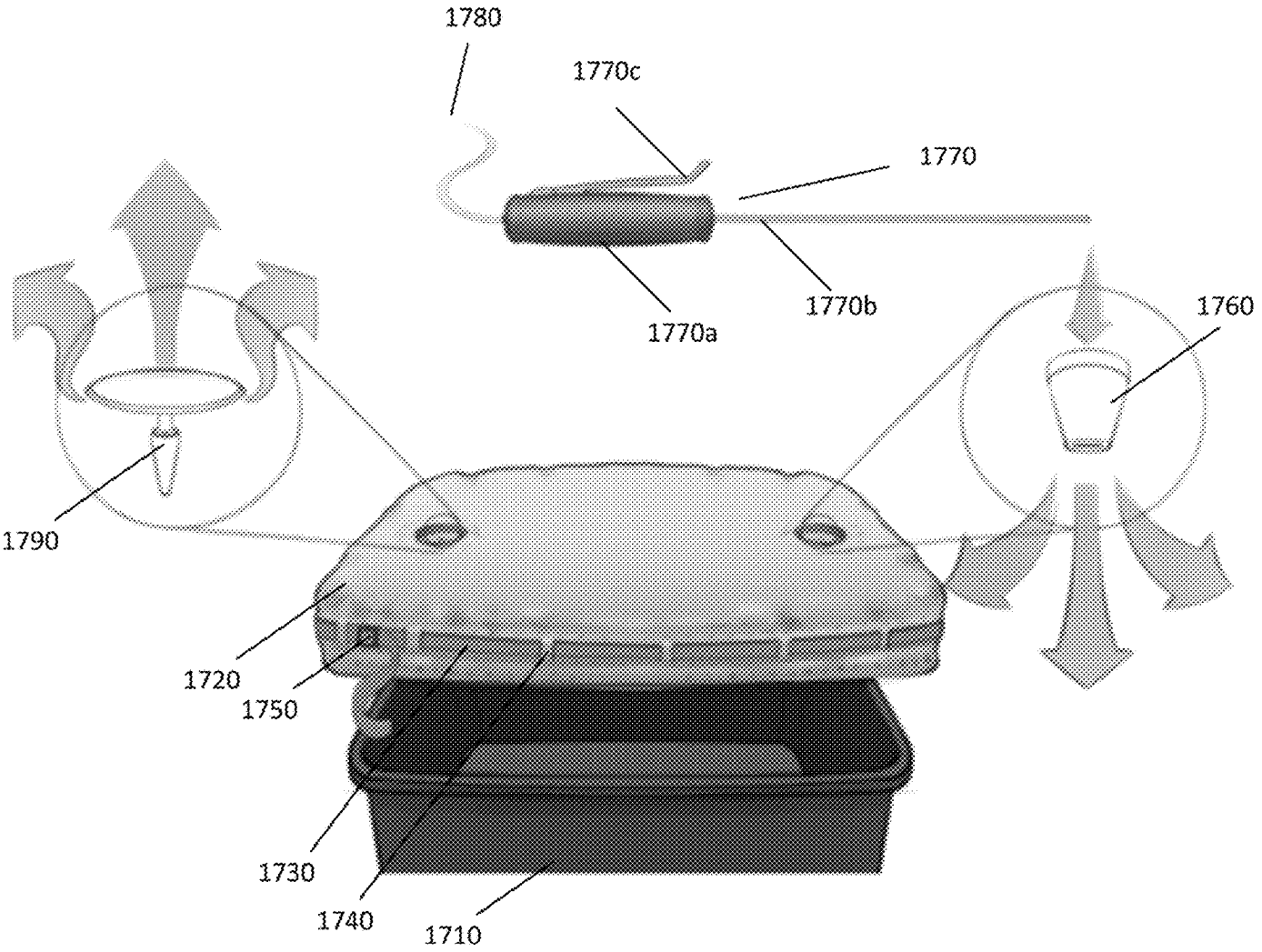
FIG. 17 shows a perspective view of a *cannabis* container with tub-like dimensions, according to certain embodiments of the present invention.

FIG. 17 shows a perspective view of a *cannabis* container with tub-like dimensions, according to certain embodiments of the present invention. As shown in FIG. 17, a container for holding *cannabis* may have tub-like dimensions. For example, tub 1710 may have an interior volume capable of holding about 5 pounds of *cannabis*. Nevertheless, tub 1710 may have other dimensions and may be scaled up or down. Furthermore, in certain embodiments any container with a similar lid or top opening may be substituted for the rectangular tray shown.

The tub 1710 can be covered with a cover 1720, which is shown as being formed from an elastic air-tight material. It is not necessary for the material to be elastic. The material may be impermeable to gasses at 1 atmosphere pressure. For example, the material may be made from a material that is configured to maintain gas impermeability despite a pressure differential of 95 KPA to 100 KPA, between the contents and the exterior environment. The material may be a multi-ply material, such that different layers of the material serve different functions.

Cover 1720 may be secured to the tub 1720 using a belt 1730 or other securing mechanism. A belt 1730 may be secured to the cover 1720 using belt loops 1740 and may be secured by friction fit to itself using buckle 1750. Numerous other securement mechanisms, are also permitted, such as cords or clamps. A belted securement is shown by way of illustration and not by way of limitation.

On an outer surface of the cover 1720 and penetrating to an inner surface of the cover 1720 may be at least two ports. There may be an argon insertion port 1760. Argon is used as an example of an inert gas, though other gasses are also permitted. The argon insertion port 1760 may be a one-way valve, permitting pressurized argon to pass into the tub 1710, but not to escape. In certain embodiments, an argon dispenser device 1770, including a handle **1770*a*, a needle 1770*b*, and a trigger 1770*c*. The needle 1770*b* can force open the argon insertion port 1760. After the needle 1770*b* is inserted, the trigger 1770*c* can be pressed to allow pressurized argon to rush into the tub 1710. The argon dispenser device 1770 can be attached to an argon source 1780**, which is depicted as a tube, but which may be connected to a pressurized canister of argon, or the like. Presta valves, Schrader valves, or Woods valves can be used instead of the illustrated valve. Other valve types are also permitted.

One or more degassing valve 1790 may be provided. The degassing valve may be a one-way valve configured to permit the release of gas from tub 1710. The degassing valve 1790 may be configured to release gas whenever the pressure within the tub exceeds the pressure outside the tub by a predetermined amount. As another alternative, the degassing valve 1790 may be manually operated. For example, after pumping argon gas into the tub, a user may press on or otherwise activate the degassing valve 1790 to release pressure from the tub. In certain cases, because argon is denser than oxygen, oxygen and other lighter gasses may be present in higher concentrations near the cover 1720, and consequently near an inlet of the degassing valve 1790. Accordingly, upon activation of the degassing valve 1790, the overall concentration of oxygen in the tub may decline.

The operation of the cover 1790 may be further enhanced by including a hydroscopic lining or insert, configured to capture and hold humidity within the tub.

Figure 18:
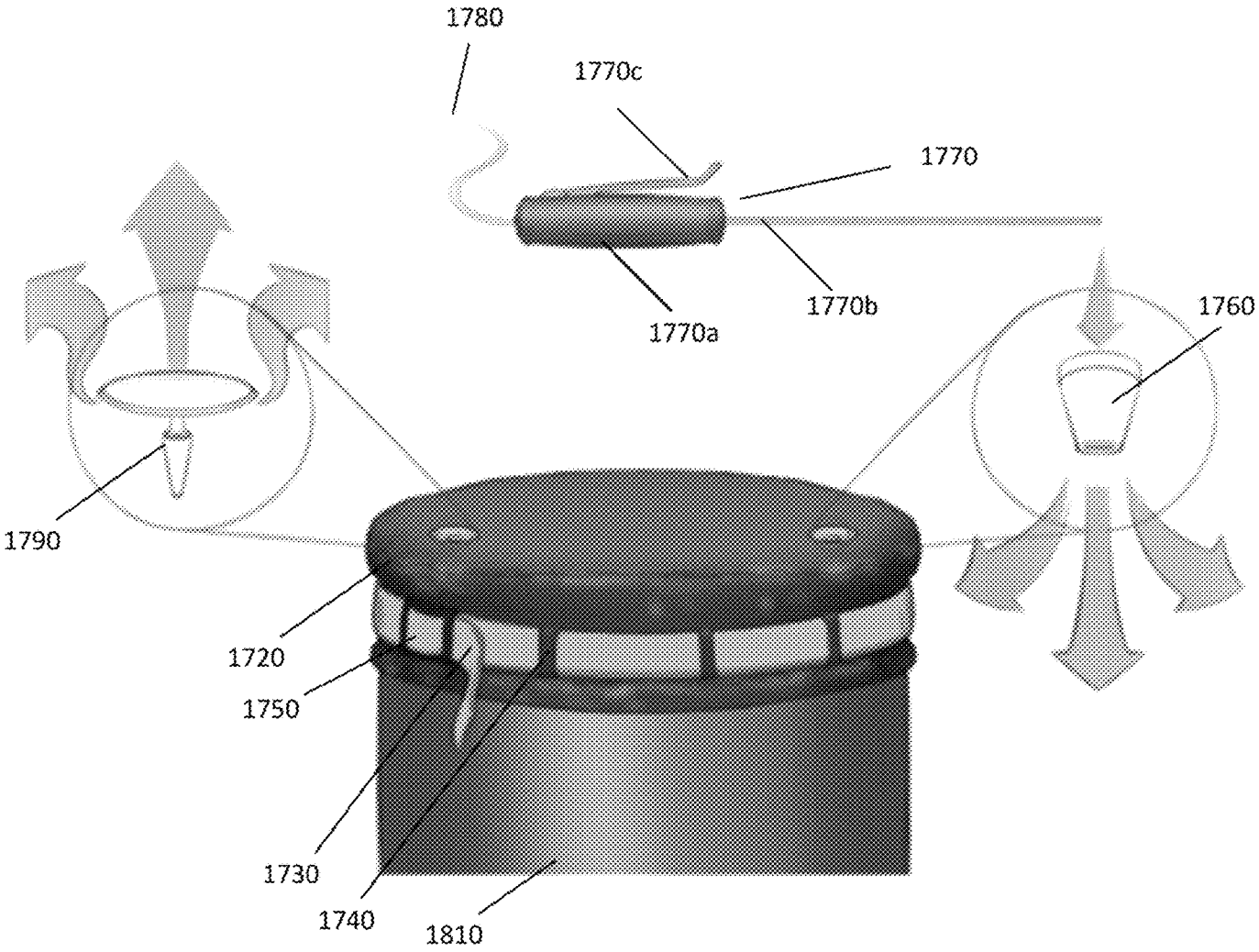
FIG. 18 shows a perspective view of a *cannabis* container with barrel-like dimensions, according to certain embodiments of the present invention.

FIG. 18 illustrates a perspective view of a *cannabis* container with barrel-like dimensions, according to certain embodiments of the present invention. As can be seen from FIG. 18, a difference between FIG. 18 and FIG. 17 is that the cover 1720 is shown uninstalled in FIG. 17 but is shown installed in FIG. 18. Additionally, instead of covering tub 1710, the cover 1720 is fastened onto barrel 1810 in FIG. 18.

Belt 1730 is shown buckled, but can also be fastened in other ways, such as by use of a hook and loop fastener, or adhesive. Other variations are also permitted. For example, tub 1710 or barrel 1810 can be used to further contain a porous bag as described above or any of the *cannabis* containers described above. In this way, multiple layers of protection from oxygen may be provided.

There are six naturally occurring noble gases: helium (He), neon (Ne), argon (Ar), krypton (Kr), xenon (Xe), and the radioactive radon (Rn). While other noble gasses may be substituted for Argon, Argon may have a benefit of being denser than helium and oxygen, less expensive than neon or krypton, and less radioactive than radon. Because helium is less dense than oxygen, if the same techniques described above were used with helium, the container may be inverted before degassing. Other inert gasses may likewise be used.

The needle 1770*b* is shown as the same length in FIG. 18 as in FIG. 17. In certain embodiments, however, a longer needle 1770*b* may be used when the depth of the storage container is greater, such that the injected argon is injected nearer to a bottom of the storage container. This may enhance the process of the denser argon occupying a lower volume of the storage container, while oxygen is moved toward the cover 1720 and through the degassing valve 1790. Although only one degassing valve 1790 is shown, multiple degassing valves are permitted.

Silicone may be used as a material for the construction of cover 1720. Other inert and gas-impermeable materials may likewise be used.

Figure 19:
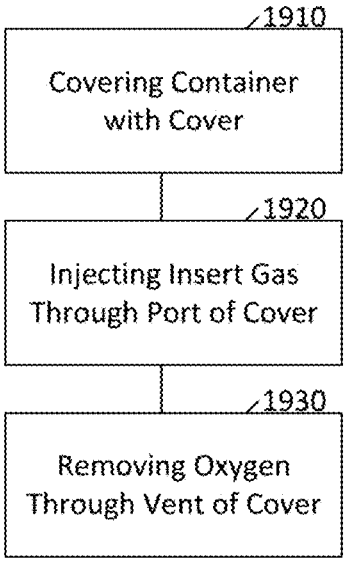
FIG. 19 shows a flow of a method according to certain embodiments of the present invention

FIG. 19 shows a flow of a method according to certain embodiments of the present invention. The method of FIG. 19 may be applied to any of the containers disclosed here, for example to the containers shown in FIGS. 17 and 18.

At 1910, the method can include covering the container with a cover. This covering can attaching the cover to the body of the container, for example using a belting system as shown in FIGS. 17 and 18, or by snap-lock or clamping attachment, or by screwing the cover onto the body of the container, or any other way. A periphery of the cover may be temporarily and removably secured to the top of the container body.

At 1920, the method can include injecting inert gas through a port of the cover. The port may be an existing inlet port in the cover. As another option, the cover may be punctured by a needle to allow gas insertion. If a puncture approach is used, a patch may be applied to cover the puncture after the inert gas is inserted. The gas can be inserted using a pressurized gas line, a pump, or the like. There can be a pump in the cover itself that can draw the inert gas into the container, or the cover can include a passive valve that allows the gas to enter when supplied under pressure.

At 1930, the method can include removing oxygen through a vent in the cover. The vent can be a one-way valve or the like. The vent can be located at a predetermined distance from the port. For example, in a tub-shaped container cover, the port may be at one end of the tub, and the vent may be at the other end of the tub. Multiple vents can be provided. Vents can be opened by a user of the device or the vents may open when the pressure inside the container exceeds atmospheric pressure by a predetermined amount.

In certain embodiments, the packing of the container may be initially performed in a vacuum environment. In this case, the vent may be omitted from the cover. Instead, the port may be used to inject inert gas into the container to limit the amount of atmospheric oxygen that enters the container after the container leaves the vacuum environment.

Optionally, a transparent material may be used for the cover material, such as a transparent plastic material. A patch of material that gradually changes color over time in the presence of oxygen may be installed on an inside surface of the container. This patch of material may serve to confirm that the inert gas is preventing oxygen from existing in significant quantities inside the container.

Other modifications and combinations of the above are permitted. For example, the cover shown in FIGS. 17 and 18 may be formed of a very resilient material that permits a similar function of allowing the removal of air through the vent(s) when the cover of the container is depressed. For example, an elastic material may be provided between the periphery and a central portion of the container cover, which may allow the volume of gas inside the container to be reduced by applying weight to a top surface of the container.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

The invention claimed is:

1. A storage apparatus for airtight storage of *cannabis* comprising:

a container;

an air-tight cover secured to the container;

a degassing valve provided on the cover, the degassing valve being configured to release gas from the container when a first pressure within the container exceeds a second pressure outside the container by a predetermined amount; and a nozzle with a needle that is configured to deliver an inert gas to an interior of the container via insertion of the needle into a gas injection port provided on the cover, wherein the nozzle includes an actuator for initiating flow of the inert gas.

2. The storage apparatus of claim 1, wherein the cover is secured to an exterior surface of the container.

3. The storage apparatus of claim 1, wherein a position of the cover is fixed relative to the container when gas is released from the degassing valve when the first pressure within the container exceeds the second pressure outside the container by a predetermined amount.

4. The storage apparatus of claim 1, wherein the cover includes a belt and a buckle that utilize a friction fit to secure the cover to the container.

5. A storage apparatus for airtight storage of *cannabis* comprising:

a container;

an air-tight cover secured to the container;

a degassing valve provided on the cover, the degassing valve being configured to release gas from the container when a first pressure within the container exceeds a second pressure outside the container by a predetermined amount; and an internal storage bag that is porous to allow for the displacement of oxygen in the container with the inert gas.

* * * * *